United States Patent [19]

Zielinski et al.

[11] Patent Number: 4,936,791

[45] Date of Patent: Jun. 26, 1990

[54] ENVIRONMENTAL SEAL MEANS FOR PLUG AND SOCKET CONNECTOR ASSEMBLY

[75] Inventors: Thomas E. Zielinski, Saint Clair; Paul W. Geyer, Rochester; Charles E. Hendricks, St. Clair Shores, all of Mich.

[73] Assignee: Chrysler Corporation, Highland Park, Mich.

[21] Appl. No.: 383,508

[22] Filed: Jul. 24, 1989

[51] Int. Cl.[5] ..... H01R 4/00

[52] U.S. Cl. ..... 439/271

[58] Field of Search ..... 439/271–276

[56] References Cited

U.S. PATENT DOCUMENTS 4,029,382 6/1977 Koda ..... 439/272

4,637,674 1/1987 Kobler ..... 439/271

*Primary Examiner*—Joseph H. McGlynn

*Attorney, Agent, or Firm*—Wendell K. Fredericks

[57] ABSTRACT

An environmental seal for a plug and socket connector assembly that protects interior terminals from environmental elements yet minimizes mating forces needed to mate terminals in the plug with the terminals in the socket.

5 Claims, 1 Drawing Sheet

ENVIRONMENTAL SEAL MEANS FOR PLUG AND SOCKET CONNECTOR ASSEMBLY

BACKGROUND OF THE INVENTION

1. Field of the Invention

The present invention relates to environmental seal means for connector assemblies and in particular to seal means used in connector assemblies that enhance a socket and plug insertion action.

2. Description of the Prior Art

In-line connectors, designed to function in a variety of environmental conditions, generally include annular space between the axially extending support surfaces about the input end of the plug and socket. To prevent moisture, dust, etc. from entering this annular space, some form of a seal or packing is inserted therebetween.

The seal or packing normally mounts over the extending support surface forming the inter-radius of the annular space. With the seal in place, a problem exists normally when inserting the plug into the socket. Usually the insertion force required to mate the plug and socket becomes unreasonable because some connector assemblies are multiple terminal devices. Each terminal in the assemblies creates an insertion force problem since each terminal contributes resistance to the insertion force needed to mate the plug to the socket.

In multiple terminal connector assemblies which are subject to various external forces such as continual vibrations, extreme temperature changes, excessive wind and rain, the terminals that are employed usually have a mating force of about 25 pounds or 40 ounces per terminal. If external locking mechanisms are employed to keep the plug mated to the socket, the mating force increases by, e.g., 3 pounds or 48 ounces, which represents the force needed to operate the lock mechanism.

Where the mating force of a connector is limited to a maximum of 30 pounds and there is a requirement, illustratively, for ten terminals per connector having a mating force of 40 ounces per terminal, and the connector assembly must be environmentally sealed, a search was initiated for an environmental seal scheme that would contribute a minimum mating force.

The prior art contains environmental seals for use in the annular space between the axially extending support surfaces of sockets and plugs of environmentally sealed connector assemblies.

Some forms of environmental seals have ribs or flanges that fold over onto the shaft of the seal and on or against adjacent ribs. Other seals have ribs that merely fold over onto the shaft of the seal but are compressed between the two extending support surfaces of the plug and socket respectively.

Such seals that fold as well as compress usually require the need for a relatively high insertion force for mating the plug and socket. A similar result occurs when the ribs of the seal overlap.

These prior art sealing arrangements are unacceptable when mating forces must be kept to a minimum.

BRIEF SUMMARY OF THE INVENTION

The present invention is concerned with environmental seals for in-line connectors that minimize the insertion force needed for mating the plug and socket of connector assemblies. A seal structure is provided which substantially eliminates any compressive force that would contribute to the mating force, yet permits a sealing action even though the insertion force needed for mating the terminals of the plug and socket is not effected.

DETAILED DESCRIPTION

Figure 2:
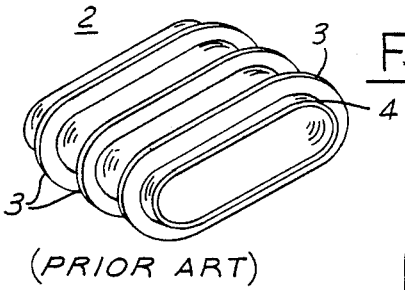
FIG. 2 is a prior art ring seal means used in the connector assembly of FIG. 1.
Figure 1:
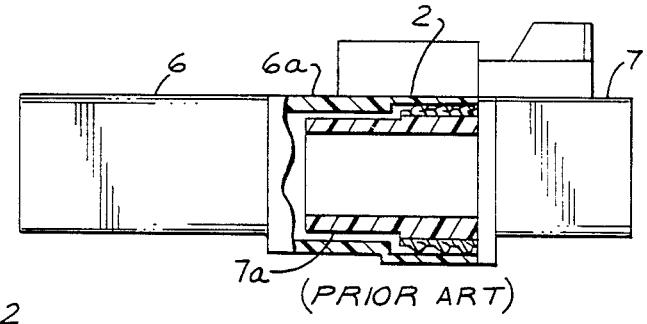
FIG. 1 is partially sectioned plan view of a prior art connector assembly.

Referring to the drawing, there is shown in the FIG. 1 a prior art connector assembly that includes a sealing means 2 disposed between extended support surfaces 6*a* and 7*a* of plug 6 and socket 7 respectively. The seal means 2 of FIG. 2 includes a plurality of ribs 3 serially disposed along a shaft 4. The shaft and ribs are of an elastomeric material which permits compressive as well as folding actions to occur during mating of the socket and plug.

With this arrangement, when the plug 6 is mated with the socket 7, the ribs 3—3 fold over onto the shaft 4 of the seal means 2 and receive a compressive as well as a shear force from the socket inner support surface 7*a* of FIG. 1. An interference rather than a clearance exists between the ribs 3—3 and the inner support surface 7*a*. This arrangement increases the mating force required to join the plug 6 to the socket 7.

Figure 4:
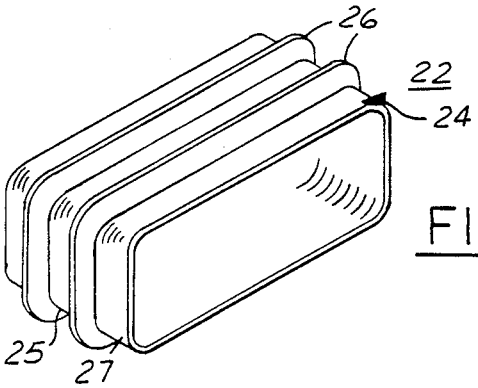
FIG. 4 is an exploded perspective view of the seal member of the present invention.
Figure 3:
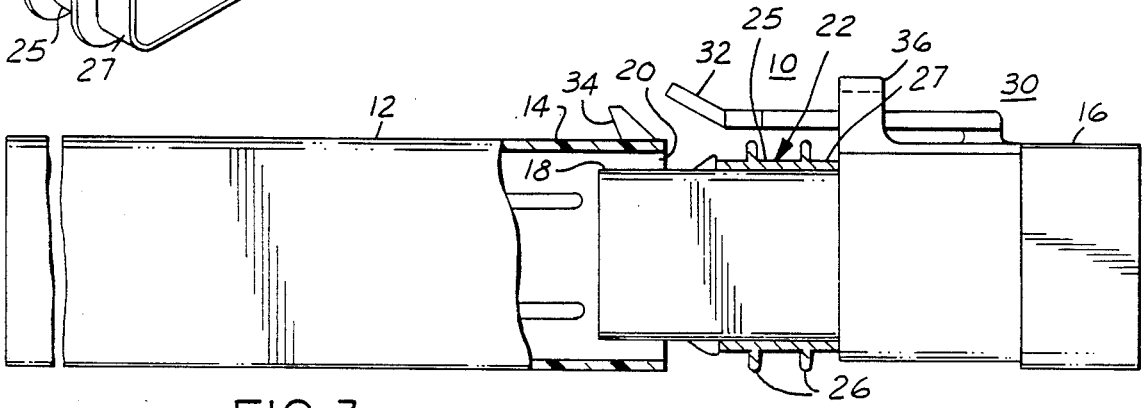
FIG. 3 is partially sectioned side view of an unmated connector assembly employing a seal member of the present invention.
Figure 5:
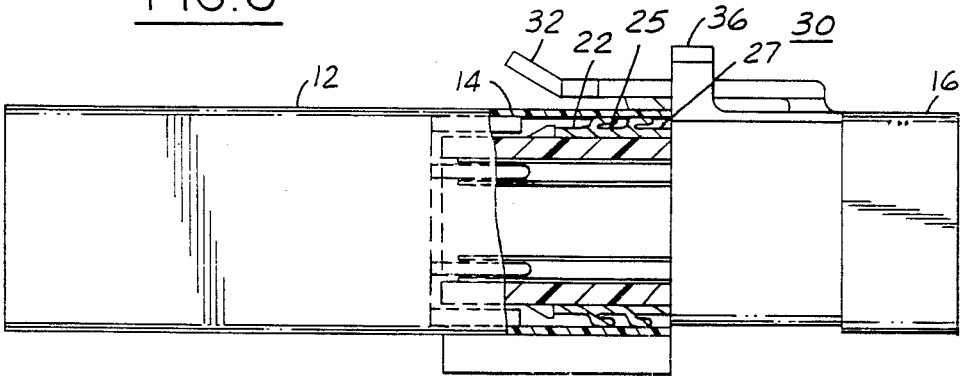
FIG. 5 is a partially sectioned side view of connector assembly of FIG. 4 illustrative of a mated connector and of the ribs of the sealed member folded to effect a seal.

To provide a connector assembly that eliminates some of the factors that contribute to the insertion force for mating a socket with a plug, a preferred embodiment of a seal and connector assembly of the present invention is depicted in FIGS. 3 through 5.

FIG. 3 depicts an un-mated connector assembly 10 which includes a plug 12 and a socket 16. Plug 12 has a plug support surface 14 which, when mated, encompasses a socket support surface 18. An annular space region 20 results between surfaces 14 and 18. Within this space, a seal means 22 of FIG. 4 is disposed.

Seals means 22 includes at least two ribs 26 spaced apart on a hollow shaft 24. The ribs 26 and shaft 24 are integrally formed of a elastomeric material that contains a lubricant (not shown). A metered amount of the lubricant contained in the seal 22 is excreted creating less drag when the ribs 26 are arcuately flexed. As shown in FIG. 4, the ribs 26 extend outwardly from the shaft 24. The ribs also have an annular radius larger in a free form condition than the radius of the annular space region 20 of FIG. 3.

In mounting seal 22 over the outer surface of the socket support surface 18 of socket 16, the shaft 22 is stretched to encompass the entire periphery of surface 18.

When plug 14 is inserted over surface 18 and seal 22, as shown in FIG. 5, the ribs 26 fold in a direction away from the end of the plug 22 and with one of the ribs 26 folding into an inner rib region 25 while another rib folds into another region 27 on the outer surface of shaft 22 adjacent to the other rib. The annular space region 20 and the thickness of the fold ribs 20—20 within the inner rib regions 25 and 27 to substantially eliminate any compressive force that would contribute to the mating force between the outer surface of the plug support structure 14 and the ribs 26—26. The folded ribs 26—26 within the annular space region 20 is sufficient to prevent seepage of liquid and solid elements from entering the connector assembly and traveling to the terminals of the plug and socket. A clearance effect rather than an interference effect results from this sealing arrangement.

To maintain the socket and plug connection, a latch-type lock assembly 30, comprised of a latch 32 and a post 34 and an overstress bar, is used to lock together the socket 16 and plug 12.

It is to be understood that the above-described embodiment is merely illustrative of the principles of the present invention. One skilled in the art may make changes and modifications to the embodiments disclosed herein and may devise other embodiments without departing from the scope and essential characteristics thereof.

I claim:

1. An environmental seal means for an in-line electric plug and socket connector assembly, the plug and socket each having an axially extended support structure, the support structures facing each other to define therebetween an annular space, and each of the support structures having an end being axially spaced from each other, the seal means comprising:

(a) an elastomeric hollow shaft encompassing the support structure in which an outer surface of the shaft forms the inner radius of the annular space; and (b) a series of more than one rib axially disposed about and integral with the outer surface of said elastomeric shaft so as to freely extend radially into contact with an inner surface of the other one of the support structures, said series of ribs having an annular radius larger than the radius of the annular space, and all said ribs in contact with the other support structure being arcuately flexed by the other support structure in a direction opposite from the end of one support structure and toward the end of the other support structure to a position substantially parallel with an outer surface of said shaft, said flexed ribs and said shaft of said seal means forming a structure between the one and the other support structures that matches the clearance between the one and the other support structures so as to oppose increasing the insertion force needed to mate the terminals within the connector assembly.

2. The seal means of claim 1 wherein one rib of said series of rib means when arcuately flexed by the other support structure, folds into an inner rib region on the outer surface of said shaft and wherein another rib of said series of rib means folds into another region on the outer surface of said shaft adjacent to said another rib, the another region having a width equivalent to the inner rib region.

3. The seal means of claim 2 wherein said one rib and said other rib, when folded into the inner rib region and another region respectively, forms a seal structure in the annular space.

4. The seal means of claim 3 wherein said sealed structure in the annular space being formed in a manner that opposes the generation of frictional or shearing force between an outer surface of said sealed structure and the inner surface of the other one of the support structure so as to minimize the insertion force between the plug and the socket of the electrical connector assembly.

5. The seal means of claim 4 containing a lubricant which excretes creating less drag when the ribs of the seal means are flexed, said lubricant being used to assist in reducing frictional forces between a rib surface and the inner surface of the other one of the support structures.

* * * * *

UNITED STATES PATENT AND TRADEMARK OFFICE

CERTIFICATE OF CORRECTION

PATENT NO. : 4,936,791

DATED : June 26, 1990

INVENTOR(S) : Thomas E. Zielinski, et al.

It is certified that error appears in the above-identified patent and that said Letters Patent is hereby corrected as shown below:

Column 2, line 64, after "ribs 26" insert --of Fig. 4-- and in line 65, correct "plug 22" to read --plug 12 of Fig. 5--.

Column 3, line 1, correct "20-20" to read --26-26--.

Column 3, line 24, correct "electric" to read --electrical--.

Signed and Sealed this

Twelfth Day of November, 1991

*Attest:*

*Attesting Officer*

HARRY F. MANBECK, JR.

*Commissioner of Patents and Trademarks*